US008376090B2

(12) United States Patent
Kostka

(10) Patent No.: US 8,376,090 B2
(45) Date of Patent: Feb. 19, 2013

(54) APPARATUS AND METHOD FOR INCREASING ELEVATOR CAPACITY IN SPECIAL SITUATIONS

(75) Inventor: Miroslav Kostka, Ballwil (CH)

(73) Assignee: Inventio AG, Hergiswil (CH)

( * ) Notice: Subject to any disclaimer, the term of this patent is extended or adjusted under 35 U.S.C. 154(b) by 361 days.

(21) Appl. No.: 12/452,487

(22) PCT Filed: Jul. 3, 2008

(86) PCT No.: PCT/EP2008/058567

§ 371 (c)(1),
(2), (4) Date: May 25, 2010

(87) PCT Pub. No.: WO2009/004055

PCT Pub. Date: Jan. 8, 2009

(65) Prior Publication Data

US 2010/0236870 A1 Sep. 23, 2010

(30) Foreign Application Priority Data

Jul. 3, 2007 (EP) ..... 07111603

(51) Int. Cl.
*B66B 5/14* (2006.01)

(52) U.S. Cl. ..... 187/281; 187/384; 187/391

(58) Field of Classification Search ..... 187/247, 187/277, 280, 281, 300, 301, 316, 317, 391–394, 187/380–388

See application file for complete search history.

(56) References Cited

U.S. PATENT DOCUMENTS

| | | | | |
|---|---|---|---|---|
| 4,708,224 | A * | 11/1987 | Schrooder | 187/388 |
| 4,838,384 | A * | 6/1989 | Thangavelu | 187/385 |
| 5,024,295 | A * | 6/1991 | Thangavelu | 187/382 |
| 5,490,580 | A * | 2/1996 | Powell et al. | 187/281 |
| 5,644,110 | A * | 7/1997 | Bahjat et al. | 187/385 |
| 5,780,786 | A | 7/1998 | Miyanishi | |
| 6,000,505 | A * | 12/1999 | Allen | 187/391 |
| 6,401,874 | B2 * | 6/2002 | Siikonen | 187/382 |
| 7,387,191 | B2 * | 6/2008 | Kostka et al. | 187/381 |
| 7,588,126 | B2 * | 9/2009 | Siikonen et al. | 187/384 |

FOREIGN PATENT DOCUMENTS

| | | |
|---|---|---|
| EP | 1 068 142 | 11/2003 |
| JP | 09 058941 | 3/1997 |
| WO | WO 99/50165 | 10/1999 |
| WO | WO 2007/042605 | 4/2007 |

OTHER PUBLICATIONS

Written Opinion of the International Searching Authority corresponding to International Application No. PCT/EP2008/058567 filed Jul. 3, 2008 (5 pages).

* cited by examiner

*Primary Examiner* — Anthony Salata
(74) *Attorney, Agent, or Firm* — Wolff & Samson, PC

(57) ABSTRACT

In accordance with the present invention concerning operation of an elevator, a traveling mode of the elevator is prevented if it is established that an elevator load exceeds a limit value. During normal operation, the limit value is equal to a first limit value. If it is established that a special situation is present (e.g., an evacuation situation or a peak traffic situation) the system is switched over to a special situation mode. In the special situation mode, the limit value is equal to a second limit value, which is higher than the first limit value.

17 Claims, 2 Drawing Sheets

APPARATUS AND METHOD FOR INCREASING ELEVATOR CAPACITY IN SPECIAL SITUATIONS

This is a U.S. national phase application under 35 U.S.C. §371 of International Patent Application No. PCT/EP2008/058567, filed Jul. 3, 2008, which claims the benefit of EP Application No. 07111603.2, filed Jul. 3, 2007, both of which are incorporated by reference herein.

FIELD OF THE INVENTION

The present invention relates to a device and a method for the operation of an elevator, and more particularly to a device and method for the operation of an elevator in which a travel operation is prevented if it is detected that an elevator load exceeds a limit-value.

BACKGROUND

From WO 99/50165, for example, a so-called overload control is known, wherein the elevator load is sensed by means of a load sensor. If the elevator load exceeds a base limit-value, a travel operation is made impossible by the elevator doors being prevented from closing. Simultaneously, an acoustic signal is issued which draws attention to the overload. Only when the load sensor senses that the elevator load no longer exceeds the base limit-value, do the doors close, and is the travel operation started, whereupon the overload signal is deactivated.

This ensures that the specified limit-values for safe operation of the elevator in relation to loading of the suspension means, driving power and braking power of the drive, braking force and holding force of the brake device, and suchlike, are not exceeded. Also, for reasons of safety, these limit-values are generally selected relatively low when they are defined, by the theoretical values that would be possible mechanically, and for the drive, being divided by safety factors greater than 1 before they are compared with the maximum loads that occur in normal operation.

Also known, for example from the said WO 99/50165, is the use of elevators also for the evacuation of persons, for example in the case of fire or bomb-threat. Above a certain height of building, such an evacuation, particularly of older people, and/or those with disabilities, can take place faster than via conventional escape routes, such as stairways. In fact, in extremely tall buildings, elevators are virtually the only possible means of evacuating the building sufficiently rapidly.

Particularly in such situations, in which the risk of failure of the elevator due to overloading recedes into the background by comparison with the consequences of insufficiently timely evacuation of persons, the deliberate selection for safety reasons of low limit-values based on normal operation prevents utilization of the full technically possible transportation capacity of the elevator. There are similarities also in other situations, for example briefly occurring peak-traffic situations, in which the low limit-values that are appropriate for normal operation unnecessarily restrict the elevator capacity.

SUMMARY OF THE INVENTION

The object of the present invention is therefore to increase the transportation capacity of an elevator in special situations.

To fulfill this objective, a method and device for the operation of an elevator is provided. During normal operation of the elevator, a travel operation is prevented if it is detected that an elevator load exceeds a base limit-value. A switchover to a special-situation mode occurs if is detected that a special situation, in particular an evacuation situation or a peak-traffic situation, is present.

According to the invention, in normal operation a conventional overload control is performed, i.e. a travel operation is prevented, if it is detected that an elevator load exceeds a base limit-value. In particular, the base limit-value can be identical with the so-called rated load, and be compared with, for example, the currently sensed payload, or the momentary total weight of an elevator car of the elevator. This elevator load can be sensed in a manner which in itself is known, by, for example, a force-measuring device on a suspension means, on the elevator car, on a drive of the elevator, and/or on a braking device of the elevator.

If it is detected that a special situation is present, switchover into a special-situation mode takes place. Such a special situation may particularly be present when the building that is served by the elevator must be evacuated. This can be sensed by reference to, for example, an evacuation alarm, which can be triggered, for example manually via a corresponding emergency switch, and/or automatically, for example by a fire detector, earthquake detector, or suchlike.

A special situation in the sense of the present invention can be, for example, additionally or alternatively a peak-traffic situation, in which, significantly higher-than-average transportation capacities are required. A special situation in the sense of the present invention can be, for example, a so-called down peak, in which a higher-than-average payload must be transported downward, since, in this case, particularly the load on the drive is lower.

In addition, however, other special situations are also conceivable, and the present invention is not restricted to evacuation and peak-traffic situations.

According to the invention, it is now foreseen that in the special-situation mode, the limit-value upon whose being exceeded by the elevator load a travel operation is prevented, is replaced by a second limit-value, which is higher than the base limit-value which is taken as the basis for normal operation.

By this means, a travel operation of the elevator is only prevented when the higher second limit-value is exceeded, so that the elevator can transport higher payloads on each travel. By this means, mechanical and drive-related reserves which are possessed by an elevator through safety factors being taken into consideration in its design, are systematically exploited. This is possible because, as stated above, in the design of elevators, relatively high safety factors are usually taken into consideration, and thus the elevator can theoretically handle higher elevator loads. Particularly in an evacuation situation, in which the risk of failure recedes into the background by comparison with the damage from insufficiently timely evacuation, the transportation capacity can thus be increased.

Elevators are generally designed for relatively long and relatively frequent normal operation. Higher loads, which occur only briefly and/or infrequently, can, however, generally be sustained by the components of the elevator. The limiting parameter for electric motors, for example, is their heating during continuous operation, which means that for brief periods they can deliver significantly greater power. Hence, in an embodiment of the present invention, switchover to the special-situation mode also takes place in peak-traffic situations with above-average requirements for the transportation capacity.

Switchover to the special-situation mode takes place, for example automatically, as soon as the presence of a special situation is detected. Additionally or alternatively, switchover to the special-situation mode can also take place manually, for example by emergency personnel in the case of an evacuation.

The travel operation is prevented by closing of a door of the elevator being prevented. Conventional elevator control systems prevent an elevator car from starting to travel while an elevator door is still open. In the case of open cars, this can be, for example, the hoistway door on a landing at which the elevator car is currently stopped. In the case of closed cars with car doors, a travel operation can be prevented while one or more car doors and/or one or more hoistway doors of the elevator is/are open. Additionally, or alternatively, a travel operation can also be prevented by other means, for example by direct blocking of a braking, holding, and/or drive device.

A second signal is issued when the travel operation is prevented because the elevator load exceeds the limit-value, which in normal operation is the base limit-value, and in special-situation mode the second limit-value. This signal can be equally well perceptible by visual, acoustic, or other means, and signals to persons who are already present in the elevator car, and/or to others arriving there, that the allowed elevator load is already exceeded, and a travel operation is prevented for as long as the elevator load is not reduced below the allowed limit-value.

For this purpose, the second signal can be equally well issued inside and/or outside the elevator car, for example in the vicinity of a hoistway door. The signal indicates by how much the allowed limit-value is exceeded (for example in kg weight), and/or how many persons (for example, by assuming an average weight of a person) must exit for the limit-value to be not exceeded. Alternatively, or additionally, the currently sensed elevator load can be displayed, so that users of the elevator realize that the elevator load can be reduced by the removal of persons or payload from the elevator car.

In an embodiment of the present invention, when, in special-situation mode, it is detected that the elevator load exceeds a third limit-value, a first signal is issued which indicates that the maximum allowed elevator load for the special situation is almost reached. Similar to the second signal, the first signal can be equally well issued by visual, acoustic, or other means, and take the form of, for example, a simple warning signal (for example, the illumination of a warning lamp and/or the sounding of a warning sound), or more specifically indicate the difference between the present and the maximum allowed elevator loads (for example as a weight or a number of average people).

The third limit-value can, for example, be identical to the base limit-value, so that in this case the first signal indicates that the maximum elevator load for normal operation is already reached. The third limit-value can be equally well chosen to be somewhat higher than the base limit-value, as long as it lies below the second limit-value at which a travel operation is prevented. Alternatively, the third limit-value can be chosen also lower than the base limit-value, so as to already indicate an impending overload promptly before the maximum elevator load is reached, and to deter further persons from boarding.

As long as only the third, but not the second, limit-value is exceeded, the elevator can be operated normally, also in special-situation mode. In particular, a doorspace monitor can still only release closing of a door when it is detected that no persons or obstacles are present in the area of the elevator doors. For this purpose, the doorspace monitor can monitor the space between elevator doors (car doors and/or hoistway doors) or the space in their vicinity, for example by means of a light curtain or photoelectric cell. Additionally, or alternatively, a doorspace monitor can also take account of signals from a hold-door-open button by means of which the elevator doors are held open manually.

In special-situation mode the elevator can also be operated in a first operating mode that differs from normal operation, if it is detected that the elevator load exceeds the third limit-value. In this first operating mode, the drive-power of the elevator, its travel profile, its braking behavior, and suchlike, can be adapted to the higher elevator load. For example, the elevator control system can take account of the higher elevator load that exceeds the third limit-value, in that the elevator car accelerates more slowly, brakes earlier, and/or is held by stronger braking forces.

In addition, or alternative, to issuing the first signal, and/or operating the elevator in the first operating mode, in an embodiment of the present invention, a fourth limit-value can be provided. If it is detected that the elevator load exceeds this fourth limit-value, which is lower than the second limit-value, the doorspace monitor can be deactivated, and closing of the elevator doors be begun. When doing so, a closing-force limiter of the elevator doors can remain active and prevent injury to persons, or damage to obstacles, by the closing elevator doors, in that on attaining a closing-force limit, the closing operation is terminated and the elevator door is—at least partly—reopened, after which a renewed attempt at closing is begun. This mode, known as "nudging control", signals, when it occurs, in addition to the first signal, that the fourth limit-value has been exceeded, and more effectively prevents further loading of the elevator car.

Such a nudging mode (also known as "final-timer function") can also take place in normal operation: if the doorspace monitor detects that the closing area of the elevator doors is continuously blocked for longer than a certain length of time, closing of the elevator doors is started, the elevator doors at least partly reopening as soon as the closing-force limit is attained, and then beginning a new attempt at closing.

However, in contrast to normal operation, in special-situation mode, i.e. independent of the release by the door-space monitor, closing of the elevator doors in nudging mode is begun as soon as the elevator car has received a travel command and/or the fourth limit-value has been exceeded. Thus, should the fourth limit-value be exceeded, the nudging mode can automatically interrupt the flow of arrivals into the elevator car, which latter can then await a travel command. This ensures that, in the special situation, the elevator car accepts as large a payload as possible.

In the same way, the doorspace monitor can also be deactivated as soon as switchover into the special-situation mode takes place, so that, independent of a limit-value being exceeded, closing of the elevator doors can begin immediately as soon as the elevator car has received a travel command, so as to begin the transportation of passengers as soon as possible, and by this means to increase the capacity.

In normal operation and/or in the special-situation mode, the nudging control can switch over into a continuous nudging mode, in which a maximum allowed closing force is exerted on the obstacle, if a predetermined number of closing attempts has already been performed without the elevator doors having completely closed. In this continuous nudging mode, the elevator doors then press continuously against the obstacle in the closing area. If the obstacle nevertheless continues to block closing of the elevator doors for a predefined length of time, the elevator, in normal operation, can also be completely blocked, since this indicates an obstacle that is not removable by nudging. If, despite continuous nudging, after a predefined time the elevator doors have still not closed, an alarm can be issued, by means of which, for example, a maintenance person is informed.

In nudging mode, the elevator doors close more slowly than in the normal case, so as not to take users unawares. In particular, by means of this nudging control, an essentially continuous stream of arrivals into the elevator car can be interrupted with gentle force. If, because of the closing, i.e. nudging, elevator doors, persons who are present in the closing area of the elevator doors, and who without deactivation of a doorspace monitor prevent closing of the elevator doors, and who would thus assist further loading of the elevator car, move out of the closing area, the elevator doors can close and the elevator car begin its travel operation.

The nudging control is continued until the elevator doors have closed, i.e., if, because of the closing-force limiter, the elevator doors, which have encountered an obstacle in the closing area, have reopened, they immediately independently begin a further attempt at closing, until the elevator doors have been successfully closed. By this means, on attaining a maximum closing force, the elevator doors can be either completely reopened again, or equally well moved by only a small amount in the direction of opening, so that they only partly reopen and the next attempt at closing can thus begin sooner.

The embodiment described above can be realized as an alternative to the previously described embodiment. That is to say, instead of the first signal being issued, the nudging mode can be executed. However, when the two embodiments are combined with each other, the fourth limit-value then being selected higher than the third limit-value, but still lower than the second limit-value. In special-situation mode, when the third limit-value is exceeded, firstly the first signal is issued. If this already results in no further persons boarding, with the doorspace monitor active the doors can be closed and the travel operation begun. If, on account of the still-active door monitor, boarding persons continue to prevent closing of the elevator door, the fourth limit-value is then exceeded and the elevator begins with nudging mode, which more insistently draws attention to the impending exceeding of the maximum elevator load, and is particularly suitable for interrupting an essentially continuous stream of arrivals into the elevator car. Should this result in success, and the elevator car doors have closed, the elevator can begin its travel operation.

Irrespective of whether a third limit-value is provided, if it is detected that the elevator load exceeds the fourth limit-value, the elevator can be operated in a second operating mode, which differs from normal operation. As stated for the first operating mode, in this second operating mode the elevator control system can take account of the higher elevator load, for example by earlier or stronger braking, slower acceleration, higher braking or holding forces, or suchlike. The second operating mode can differ from the first operating mode explained above in that account is taken of the higher elevator load. While for the first operating mode an elevator load is taken as basis that lies above the third, but below the fourth, limit-value, the second operating mode is designed for an elevator load that lies above the fourth limit-value.

The value of the fourth limit-value can be at least 110%, at least 120%, or at least 125% of the base value, which can be equal to the rated load of the elevator.

The value of the second limit-value can be at least 110%, at least 120%, at least 125%, or at least 130%, of the base limit-value.

A method according to the invention can be implemented in many different ways in a device that controls the operation of the elevator, wherein the term "control" can equally well mean "regulate". In particular, the method can be implemented in a central elevator control system, or in an individual car control system. Thus, for example, the travel operation can be equally well prevented by an elevator control system that controls one of a plurality of autonomous elevator cars, or by a central elevator control system that controls a plurality of, particularly all, elevator cars of an elevator system.

Further objectives, advantages, and characteristics of the present invention are to be understood based on the figures, claims, and following exemplary embodiments.

BRIEF DESCRIPTION OF THE FIGURES

A diagrammatically represented exemplary embodiment of the invention is described below by reference to the attached drawings, in which.

DETAILED DESCRIPTION

Figure 1:
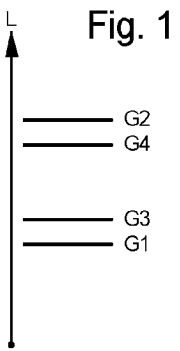
FIG. 1 is an overview of the limit-values for the elevator load that are used in the exemplary embodiment.

Shown in FIG. 1 in the sequence of their magnitude are the limit-values G1, G2, G3, G4 for the elevator load L that are used for the exemplary embodiment. The base limit-value G1 is the limit-value upon whose being exceeded a travel operation of the elevator in normal operation is prevented. The limit-value G2 is the limit-value upon whose being exceeded a travel operation of the elevator in special-situation mode is prevented. The limit-values G3 and G4 control the activation of special operating modes in special-situation mode, in which certain operating parameters of the current elevator load L are adjusted.

Figure 3:
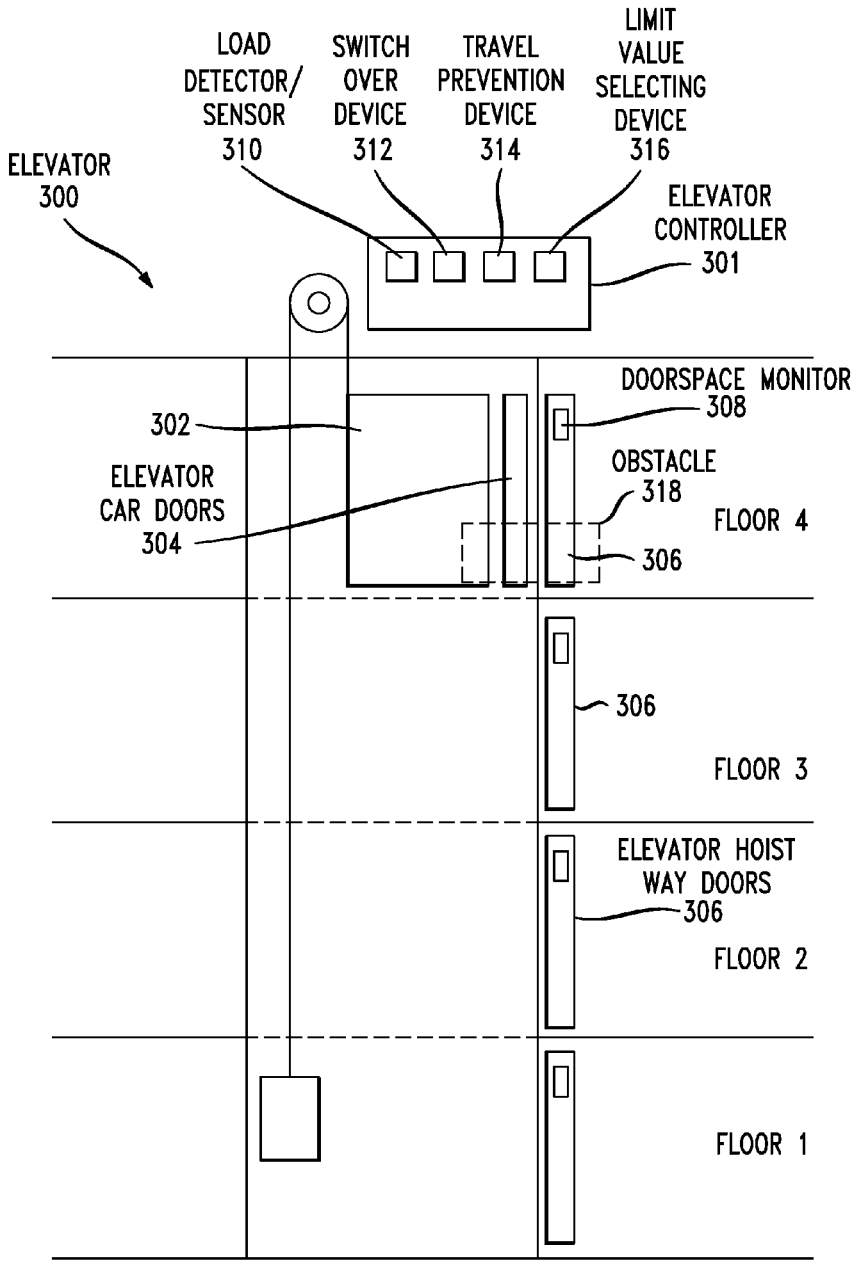
FIG. 3 depicts an elevator according to one embodiment.

FIG. 3 depicts elevator 300 according to one embodiment. Elevator 300 comprises elevator car 302 having elevator doors 304 and hoistway doors 306. Hoistway doors 306, in one embodiment, comprise door space monitor 308. Operation of elevator 300 is controlled by elevator controller 301 which, in one embodiment, comprises load detector/sensor 310, switch over device 312, travel prevention device 314, and limit value selecting device 316, each or which is described in greater detail below. Obstacle 318 is depicted in FIG. 3 in the door space of "Floor 4" preventing elevator car doors 304 and elevator hoistway doors 306 from closing.

Figure 2:
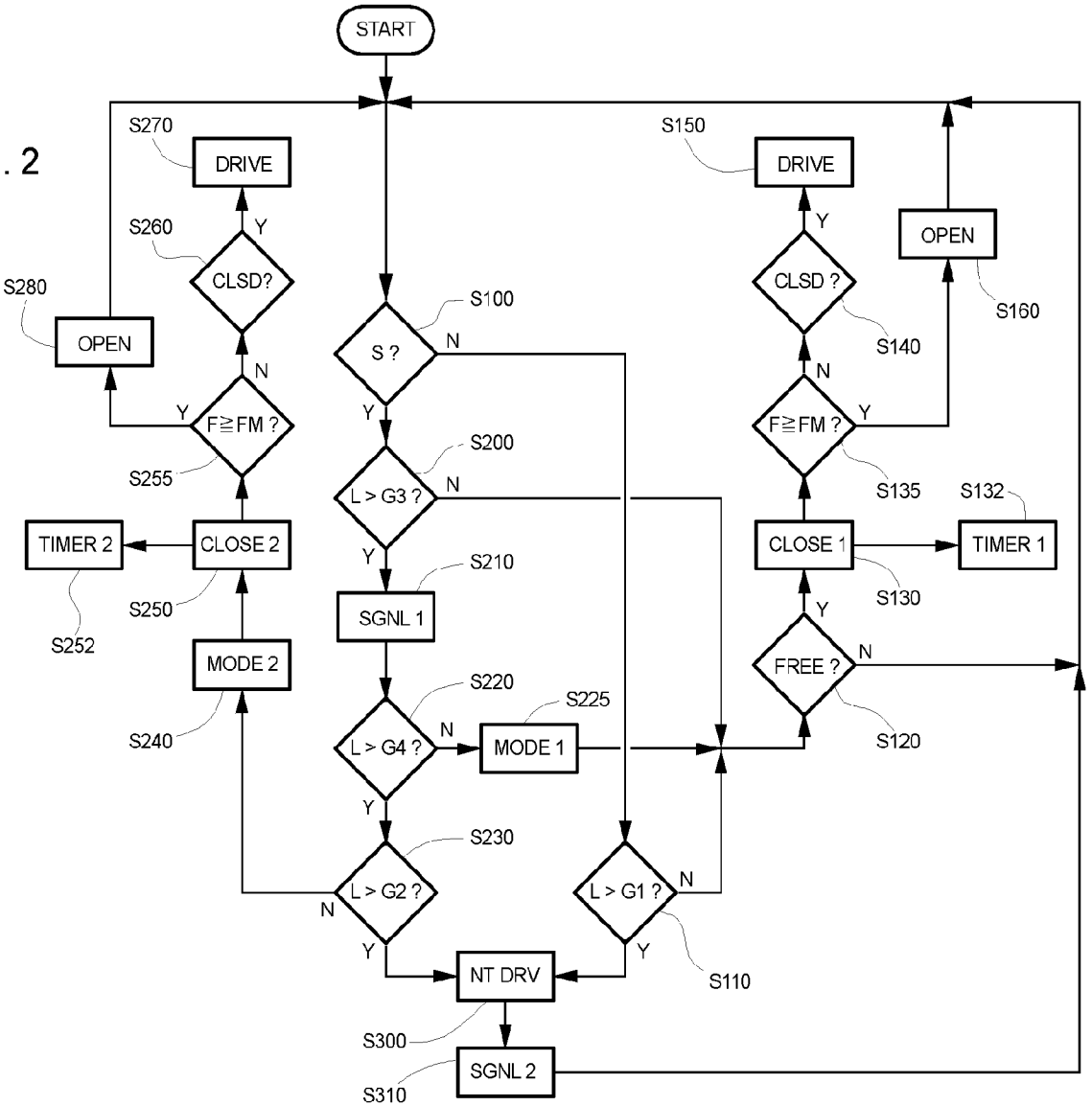
FIG. 2 is a flowchart of a method for operating an elevator according to an embodiment of the present invention.

Shown diagrammatically in FIG. 2 is the sequence of individual method-steps of a method according to an embodiment of the present invention. The individual steps can, for example, be implemented in a microcontroller, or in the form of a program that executes in a CPU. Various parts of the method can also be executed decentrally by different devices, which for this purpose can communicate with each other.

FIG. 2 shows a further embodiment of the present invention. Individual steps of the method can be omitted in a method according to the invention.

Starting with Step S100, when an elevator has received a travel command (for example through pressing of a floor button in an elevator car), a check is first made as to whether a special situation S is present.

The presence of a special situation can, for example, be detected if an evacuation alarm is issued manually (for example through actuation of an emergency button) or automatically (for example by a fire-detection device).

If it is detected in Step S100 that no special situation S is present (S100: N), the method proceeds to Step S110, in which it is checked whether an elevator load L exceeds a base limit-value G1. Selected as base limit-value G1 in the exemplary embodiment is the rated load of the elevator car of the elevator. The elevator load L is sensed in a manner which in itself is known by a force-sensing device, for example by means of strain gauges, which are arranged, for example, on a connecting element between a suspension belt and the elevator car, or between the car floor and the car body.

If it is detected in Step S110 that the elevator load L does not exceed the base limit-value G1 (S110: N), closing of the elevator doors (car and hoistway doors) is initiated. For this purpose, in Step S120, by means of a (not shown) doorspace monitor, it is determined whether the closing area between the elevator doors and the space in the vicinity of this closing area in front of, and behind, the elevator doors is free. If the doorspace monitor releases the doors for closing (S120: Y), in Step S130 a door-closing drive is actuated so as to close the elevator doors with a first speed (CLOSE 1). Provided that an allowed closing force FM is not attained (S135: N), because the closing elevator doors do not strike an obstacle, the elevator doors are completely closed (S140: Y). The elevator car can then begin its normal travel operation (S150).

If, while closing, the elevator doors strike an obstacle that presents an excessively high resistance to closing of the elevator doors, the closing force F attains a maximum allowed closing force FM (S135: Y). Thereupon, the elevator doors are at least partly reopened (S160), and the elevator control system returns to Step S100. If nothing in the situation has changed, a renewed attempt at closing will be made after previous expiration of a predefined length of time (not shown).

Simultaneous with the first-time commencement of door closing (S130) after receipt of the travel command, a timer TIMER 1 is started (S132), which counts down the normal time that is required to close the elevator doors, including a predefined number of attempts at nudging and any length of time allowed for continuous nudging. If, on expiration of this timer TIMER 1, i.e. on expiration of a predefined length of time, the elevator doors are not yet completely closed (not Y in S140), an alarm (not shown) is issued which, for example, informs a maintenance person, who then manually removes the blocking obstacle.

If, in Step S120, the doorspace monitor detects that the closing area between the elevator doors is not free, or an obstacle is present in the doorspace, i.e. in the closing area, or close in front of, or close behind, the closing area, it does not release closing of the elevator doors (S120: N). The door-closing drive is then not activated, but the elevator control system returns to Step S100. If nothing in the situation has changed, the elevator control system executes steps S100 to S120 again, until the obstacle is removed from the doorspace and the doorspace monitor releases closing of the door (S120: Y). If a predefined length of time expires during which the doorspace monitor does not release the elevator doors for closing, switchover to nudging mode takes place and closing begins nevertheless (not shown).

If in Step S110 in normal operation it is detected that the elevator load L exceeds the base limit-value G1 (S110: Y), closing of the elevator doors is prevented (S300). This causes a travel operation of the elevator to be prevented while the elevator doors are open. In the following Step S310, a second signal SGNL 2 is issued, which indicates to the passengers who are in the elevator car that the allowed elevator load is exceeded. For this purpose, a display in the elevator car can be illuminated, which indicates in a warning color, for example red, that the allowed maximum elevator load in kg is exceeded. Simultaneously, an acoustic warning signal in the form of a continuous sound can be issued, while closing of the doors is prevented by the overload control (S310). The elevator control system returns to Step S100, so that closing of the elevator doors (S300) is prevented, and issuing of the signal SGNL 2 (S310) is maintained until so many passengers have left the elevator car that the elevator load L no longer exceeds the base limit-value G1 (S110: N).

If, in Step S100, it is detected that a special situation is present (S100: Y), switchover to the special-situation mode takes place, which is shown in outline in the flowchart according to FIG. 2 with step numbers starting with 200. In Step S200 it is first determined whether the elevator load L exceeds a third limit-value G3. The limit-value G3 is here selected to be, for example, equal to the base limit-value G1, but can also be higher or lower than this limit-value. If the elevator load L does not exceed the third limit-value G3 (S200: N), the procedure as described above for normal operation is executed, i.e. a check is made of whether the doorspace is free (S120), the doors are closed (S130), and, if the doorspace monitor releases closing of the elevator doors (S120: Y), the travel operation is begun (S150). If the doorspace monitor does not release closing of the doors (S120: N), or if during closing the maximum allowed closing force FM is attained (S135: Y) because an obstacle is present in the closing area, the doors remain open, or are opened, and the elevator control system returns to Step S100. Also in special-situation mode, the elevator can thus be operated as in normal operation, as long as the elevator load L does not exceed the third limit-value G3, which is identical to the base limit-value G1. In a not-shown variant, in special-operation mode (S100: Y), Step S120 is also skipped, i.e. the doorspace monitor is deactivated and closing of the elevator doors is begun (S130) immediately as soon as the elevator car has received a travel command.

If, in special-situation mode, the elevator load L exceeds the third limit-value (S200: Y), a first signal SGNL 1 is issued (S210). In the exemplary embodiment, this corresponds partly to the second signal SGNL 2 that is described above, i.e. the difference between the actual elevator load L and the allowed limit-value G2 is displayed visually in the elevator car in a different color than the warning color, for example green, but still no warning signal is issued.

Since the first signal SGNL 1 does not yet display an exceeding of the maximum elevator load G2 that is allowed in the special-situation mode, but only indicates an impending overload, the first signal SGNL 1 is also issued outside the elevator car in the vicinity of the hoistway doors, to inform further persons that the respective elevator car is not yet maximally loaded but the maximum possible payload is already almost reached.

Next, in Step S220, a check is made of whether the elevator load L also exceeds a fourth limit-value G4 whose value is 125% of the base limit-value G1. If this is not the case (S220: N), the elevator load L lies between the third and fourth limit-value G3 and G4. Correspondingly, in Step S225, the elevator control system adapts the operating mode by selecting a first operating mode MOD1 that differs from normal operation. In this first operating mode, the elevator car is accelerated more slowly, and braked sooner, so as to take account of the elevator load L>G3 that exceeds the base limit-value G1. In all other respects, the elevator is operated as in normal operation, i.e. the door is closed and the travel operation commenced if the doorspace monitor releases closing (S120: Y) and the elevator doors were able to close (S140: Y) without reaching their limited maximum closing force FM (S135: N). Otherwise, the elevator doors are at least partly (re)opened, or remain so (S160), and the method procedure returns to Step S100. As long as nothing in the situation changes, the elevator control system, which continues to issue the first signal SGNL 1, which indicates that the maximum elevator load is almost reached, waits for the doorspace to become free (S120), or for the elevator doors to close with their maximum closing force (S140), and then commences the travel operation in the first operating mode (S150).

In the not-shown variant, in special-operation mode (S100: Y), Step S120 is always skipped, i.e. even when the fourth limit-value G4 is not exceeded (S220: N), i.e. the doorspace monitor is deactivated, and closing of the elevator doors is begun (S130) immediately as soon as the elevator car has received a travel command.

If in Step S220 it is detected that the elevator load also exceeds the fourth limit-value G4 (S220: Y), in the succeeding Step S230 a check is made of whether the elevator load L also exceeds the second limit-value G2, whose value is 130% of the base limit-value G1.

If the elevator load L also exceeds the second limit-value G2 (S230: Y), i.e. 130% of the rated load, in the same manner as when the rated load G1 is exceeded in normal operation (S110: Y), closing of the elevator doors, and thus a travel operation, is prevented (S300,) and the second signal SGNL 2 is issued (S310). Different from the first signal (SGNL 1), which only indicates an impending overloading of the elevator car, the second signal SGNL 2 indicates that the maximum allowed elevator load for the respective operating mode (normal operation or special-situation mode) is already exceeded. In addition to the differently colored visual display of the difference between elevator load and allowed limit-value (SGNL 1), this can, for example, also be emphasized by the acoustic warning sound, and/or the illumination of a corresponding message, a corresponding symbol, or a corresponding warning lamp.

The process control then returns to Step S100. As long as nothing in the situation changes, i.e. while the elevator load L exceeds the second limit-value G2 (S230: Y), closing of the elevator doors (S300), and thus a travel operation of the elevator, are prevented, and the second signal SGNL 2 is issued (S310).

By taking account of the higher second limit-value G2, whose value is 1.3 times the base limit-value G1, a travel operation of the elevator in the special-situation mode, in particular in the case of an evacuation of the building by the elevator, is only prevented when its load-bearing capacity, driving power, and braking power would also be exceeded if a lower safety factor were applied. By this means, the transportation capacity of the elevator in the special situation can be substantially increased. When selecting the second limit-value, an evaluation of the risk of failure presented by a lower safety factor, and thus a lower safety reserve in relation to, for example, load-bearing capacity, tractive capacity, driving power, and/or braking power, must be balanced against an evaluation of the damage that may result from an insufficiently prompt evacuation.

If, for example, a special situation is a peak traffic situation, to select the second limit-value, for example, instead of continuous operation, an intermittent operation of an electric motor that serves as drive can be assumed, and/or instead of the long-term strength, a short-term strength of individual mechanical components can be assumed.

If it is detected in Step S230 that the elevator load L does not exceed the second limit-value G2 (S230: N), the travel operation can be executed with the lower safety factor, and still equally safely. However, this is limited, in that switchover (S240) takes place into a second operating mode MOD2 in which, by comparison with the first operating mode MOD1, acceleration is even slower, and braking takes place even earlier, to take account of the (still) higher elevator load L>G4.

If the weight of the elevator lies between the fourth and the second limit-values G4<L≦G2 (S220: Y and S230: N), the travel operation can, if required, still be executed safely in a changed operating mode MOD2. However, a further loading of the elevator car should be limited or prevented. In this case, therefore, a nudging operation is executed, in which a door-closing drive is activated (S250) independent of whether a doorspace monitor releases closing of the doors or not. So as not to startle still-boarding persons by rapidly closing elevator doors, in nudging mode the elevator doors are closed with reduced speed (S250: CLOSE 2), with the maximum closing force being limited as in normal mode. If, under this maximum closing force (S260: Y), the doors can close, when they have done so, the travel operation is commenced in the second operating mode MOD2 (S270).

If, while the elevator doors are closing, they encounter an obstacle which, with their maximum allowed closing force, they cannot overcome, i.e. if the closing force F reaches a maximum allowed value FM (S255: Y), they are at least partly reopened (S280). The elevator control system then returns to Step S100. If nothing in the situation has changed, i.e. if the elevator load L is still below the second limit-value G2 (S230: N), the door-closing drive is reactivated (S250). Then, in contrast to the normal mode described above, there is no wait for a predefined length of time, but re-closing of the elevator doors begins immediately after these have at least partly opened, i.e. the elevator doors nudge. By their doing so, a flow of arrivals into the elevator car is interrupted by gentle force, and the elevator users, who, particularly in a panic situation, overlook or ignore the first signal SGNL 1, are haptically made aware that further loading is about to cause overloading of the elevator and thus prevent a travel operation.

If the attempts at nudging remain unsuccessful for more that a predefined length of time, i.e. if in Step S255 a predefined length of time Y is detected, the elevator control system switches over to continuous nudging, in which the elevator doors, on attaining the maximum allowed closing force FM, do not at least partly reopen, but continuously with this closing force FM press against the obstacle in the closing area (not shown). Different from normal operation, in which switchover to such a continuous nudging mode also occurs, if the attempts at nudging remain without success for a predefined length of time, i.e. in Step S135 a predefined number Y is detected, (not shown), in special-operation mode the elevator car is also not blocked even if the continuous nudging mode is executed for a predefined length of time without the elevator doors being able to completely close.

Even if, when the fourth limit-value G4 is exceeded, closing of the elevator doors is only begun for the first time (S250) after receipt of the travel command, a timer TIMER 2 is activated (S252), which counts down a predefined time, which, for example, is identical to the time that the elevator doors require to close completely, when a predefined number of attempts at nudging, and any predefined length of time for continuous nudging, are taken into account. If this predefined time has expired, i.e. the timer TIMER 2 has counted down without the elevator doors having completely closed (S260: N), an alarm is again issued (not shown), which summons a maintenance person and/or informs an elevator control system center of the problem, since it must be assumed that the obstacle will also not be removed by further (continuous) nudging.

The method described above is an embodiment of the present invention. However, individual sections of the method may be omitted. In particular, the branching depending on exceeding of the third limit-value (S200), and/or the branching depending on the fourth limit-value (S220), can be omitted. Also in this case, the transportation capacity of the elevator in a special situation (S100: Y) is increased through a travel operation only being prevented (S300) when the elevator load L exceeds a second limit-value G2 (S230: Y), which is larger than the base limit-value G1, upon whose being exceeded in normal operation (S100: N) a travel operation is already prevented (S110: Y, S300). In the special situation, the elevator can therefore transport elevator loads that are greater by the difference G2-G1.

The invention claimed is:

1. A method for the operation of an elevator comprising:

in a normal operation mode, preventing a first travel operation in response to detecting that an elevator load exceeds a base limit-value;

switching to a special-situation mode in response to detecting a special situation; and in the special-situation mode, preventing a second travel operation in response to detecting that the elevator load exceeds a second limit-value, the second limit-value being greater than the base limit-value.

2. The method of claim 1, wherein the special situation is at least one of an evacuation situation and a peak-traffic situation.

3. The method of claim 1, wherein preventing the second travel operation comprises preventing a door of the elevator from closing.

4. The method of claim 3, wherein the door comprises at least one of a car door and a hoistway door.

5. The method of claim 1, further comprising issuing a signal in response to preventing the second travel operation.

6. The method of claim 1, further comprising, in the special situation mode, issuing a signal in response to detecting that the elevator load exceeds a third limit-value.

7. The method of claim 1, further comprising switching from the special-situation mode to a first operating mode in response to detecting that the elevator load exceeds a third limit-value, wherein the first operating mode differs from normal operation.

8. The method of claim 7, wherein the third limit-value is greater than or equal to the base limit-value, and the third limit-value is less than the second limit-value.

9. The method of claim 1, further comprising, in the special-situation mode, closing a door of the elevator in response to at least one of receiving a travel command and detecting the elevator load exceeds a fourth limit-value.

10. The method of claim 9, wherein closing the door is initiated although a doorspace monitor detecting an obstacle in a doorspace of the door.

11. The method of claim 1, further comprising, in the special-situation mode, operating the elevator in a second operating mode in response to detecting that the elevator load exceeds a fourth limit-value, wherein the second operating mode differs from the normal operating mode.

12. The method of claim 9, wherein the fourth limit-value is greater than or equal to the base limit-value, and the fourth limit-value is less than the second limit-value.

13. The method of claim 11, wherein the fourth limit-value is greater than or equal to the base limit-value, and the fourth limit-value is less than the second limit-value.

14. A device for operating an elevator comprising:

a load-sensing device for sensing an elevator load;

a switchover device for switching operation of the elevator from a normal operation mode into a special-situation mode in response to detecting a special situation;

a travel-operation prevention device configured to prevent a travel operation in response to detecting that the elevator load exceeds a momentarily assigned limit-value; and a limit-value selecting device configured to set the momentarily assigned limit-value to a base limit-value in the normal operation mode, and to set the momentarily assigned limit-value to a second limit-value in special-situation mode selects the higher, the second limit-value being greater than the base limit-value.

15. The device of claim 14, wherein the special situation comprises at least one of an evacuation situation or a peak-traffic situation.

16. The device of claim 14, further comprising a signal-issuing device configured to issue a signal in response to the travel operation prevention device preventing the travel operation.

17. The device of claim 14, further comprising an operating-mode selecting device configured to activate a second operating mode, the second operating mode being different than the normal operating mode.

* * * * *